US007188462B2

(12) United States Patent
Hendrix et al.

(10) Patent No.: US 7,188,462 B2
(45) Date of Patent: Mar. 13, 2007

(54) HIGH-STRENGTH SPUN YARN PRODUCED FROM CONTINUOUS HIGH-MODULUS FILAMENTS, AND PROCESS FOR MAKING SAME

(75) Inventors: James Easton Hendrix, Pacolet, SC (US); Donald Hershel Hamrick, Belmont, NC (US); Harold B. Edwards, Harrisburg, NC (US)

(73) Assignee: Stowe-Pharr Mills, Inc., McAdenville, NC (US)

( * ) Notice: Subject to any disclaimer, the term of this patent is extended or adjusted under 35 U.S.C. 154(b) by 90 days.

(21) Appl. No.: 10/913,930

(22) Filed: Aug. 6, 2004

(65) Prior Publication Data

US 2006/0026945 A1 Feb. 9, 2006

(51) Int. Cl.
*D02G 3/02* (2006.01)

(52) U.S. Cl. ..... 57/236; 57/255

(58) Field of Classification Search ..... 57/236, 57/237, 252, 255; 19/0.35
See application file for complete search history.

(56) References Cited

U.S. PATENT DOCUMENTS

| | | | | |
|---|---|---|---|---|
| 2,305,312 | A | 12/1942 | Kern | |
| 3,503,100 | A | 3/1970 | Glynn III, et al. | |
| 3,650,104 | A | 3/1972 | Shepherd et al. | |
| 3,852,948 | A | 12/1974 | Ruddell et al. | |
| 4,080,778 | A | 3/1978 | Adams et al. | |
| 4,112,548 | A | 9/1978 | Sauvage | |
| 4,477,526 | A | 10/1984 | Lauterbach | |
| 4,686,096 | A | 8/1987 | Schulz et al. | |
| 4,698,956 | A | 10/1987 | Clarke et al. | |
| 4,825,635 | A | 5/1989 | Guevel et al. | |
| 4,924,556 | A * | 5/1990 | Gilhaus | 19/0.35 |
| 5,456,981 | A * | 10/1995 | Olry et al. | 428/359 |
| 5,910,361 | A | 6/1999 | Guevel et al. | |
| 6,040,051 | A | 3/2000 | Yamamoto et al. | |

(Continued)

FOREIGN PATENT DOCUMENTS

EP 1 205 587 A2 5/2002

(Continued)

OTHER PUBLICATIONS

International Search Report for PCT Application No. PCT/US2005/026706; Filed Jul. 28, 2005; Date of Completion Nov. 15, 2005; Date of Mailing Nov. 22, 2005.

*Primary Examiner*—Shaun R. Hurley
(74) *Attorney, Agent, or Firm*—Alston & Bird LLP

(57) ABSTRACT

A process for making a high-strength spun yarn begins by feeding one or more tows of substantially uncrimped continuous filaments of high-modulus material having a tensile modulus exceeding about $20\times10^6$ psi through a high-speed stretch-breaking apparatus operating at low total draft ratio (preferably about 2.0) to break the filaments into high-modulus staple fibers having an average length in the range of about 5 to 6 inches. The tows advantageously are heavy, for example, having a denier of about 25,000 to about 500,000. Following the stretch-breaking step, the staple fibers are collected in sliver cans, and the staple fibers are advanced from the sliver cans to a spinning machine, where the fibers are spun into yarn. An important aspect of the invention is that no intermediate processes are performed between the stretch-breaking and spinning processes, which minimizes disruption of the alignment of and damage to the staple fibers.

26 Claims, 2 Drawing Sheets

U.S. PATENT DOCUMENTS

| | | | | |
|---|---|---|---|---|
| 6,066,395 | A | 5/2000 | Miyoshi et al. | |
| 6,120,894 | A | 9/2000 | Yamamoto et al. | |
| 6,294,252 | B1 | 9/2001 | Yamanaka et al. | |
| 6,477,740 | B1 * | 11/2002 | Hansen | 19/0.35 |
| 6,783,851 | B2 * | 8/2004 | Crawford et al. | 428/364 |
| 2003/0099830 | A1 | 5/2003 | Cho et al. | |
| 2003/0209428 | A1 * | 11/2003 | Hirahara et al. | 204/294 |
| 2004/0025486 | A1 * | 2/2004 | Takiue | 57/224 |
| 2004/0028884 | A1 * | 2/2004 | Woolstencroft | 428/292.1 |
| 2004/0081825 | A1 | 4/2004 | Perrotto et al. | |
| 2004/0109991 | A1 * | 6/2004 | Guevel et al. | 428/298.1 |
| 2005/0008855 | A1 * | 1/2005 | Figuly et al. | 428/364 |

FOREIGN PATENT DOCUMENTS

| | | | |
|---|---|---|---|
| JP | 01 280034 | A | 11/1989 |
| JP | 04327206 | A | 11/1992 |
| WO | WO 89/01999 | | 3/1999 |

* cited by examiner

HIGH-STRENGTH SPUN YARN PRODUCED FROM CONTINUOUS HIGH-MODULUS FILAMENTS, AND PROCESS FOR MAKING SAME

BACKGROUND OF THE INVENTION

Many products that have historically been produced from natural materials or materials reinforced with steel are now being produced from fiber-reinforced plastics. For instance, golf club shafts, fishing poles, skis, snowboards, and a host of other products that were once made from natural wood or metal tubing, are now being produced from matrix resins reinforced with high-modulus fibers such as carbon, aramid, and the like. The high-modulus fibers used in these applications may be short chopped fibers dispersed in a matrix resin, continuous strands of filament impregnated with matrix resin, or fabrics that have been mandrel-wound, stitch-bonded, knitted, or woven into desired structural forms. These fiber-reinforced plastic structures are finding ever-increasing usage and acceptance in the marketplace as both replacements for conventional products and innovative new product forms.

There is an economic problem associated with the production of continuous fine filament high-modulus strands, in that they are relatively expensive to produce, especially in the form of fine filament yarns. A plant designed to manufacture continuous filament strands can produce either coarse strands or fine strands. A coarse strand set-up will produce more pounds of filament per day than a fine strand set-up, and consequently fine filament strands will cost more per pound to produce than coarse filament strands. When specific applications call for very fine high-modulus filament strands, the cost to produce them may become prohibitive, and alternative lower-modulus materials that are less costly to produce end up being used for such applications.

A partial solution to the economic problems associated with production of fine high-modulus strands is to convert relatively high-denier continuous filament tow strands into staple slivers that can be spun into fine textile spun yarns. For instance, in the case of carbon filaments, U.S. Pat. No. 4,825,635 to Gueval et al. describes a process wherein multifilament carbon yarns of 1500–20,000 denier are converted into staple fibers using a slow multi-step process involving "cracking by drawing and controlled breaking", yielding fibers whose average length is 100 to 120 mm (3.9 to 4.7 inches). The fibers are then spun into yarn using standard spinning equipment, which would typically involve the sequence of breaker drawing, finisher drawing, roving, and spinning. Such a yarn is deficient in physical properties, in that Guevel notes that 30 percent of the original strength of the filament carbon yarn is lost in formation of this spun yarn.

BRIEF SUMMARY OF THE INVENTION

The present invention addresses the above needs and achieves other advantages, by providing a process for making a high-strength spun yarn, and a yarn made by such process, wherein the losses in tensile and flexural strength of the yarn relative to a comparable continuous-filament yarn are substantially less than 30 percent, and less than 15% waste is produced. Furthermore, surprisingly, the shear strength of the spun yarn can substantially exceed that of comparable continuous-filament yarn.

In accordance with one embodiment of the invention, a process for making a high-strength spun yarn begins by feeding one or more tows of uncrimped continuous filaments of high-modulus material having a tensile modulus exceeding about $20\times10^6$ psi, and perhaps as high as $33\times10^6$ psi or higher, through a high-speed stretch-breaking apparatus to break the filaments into high-modulus staple fibers having an average length in the range of about 5 to 6 inches. The tows advantageously are heavy, for example, having a denier of about 25,000 to about 500,000. The tows can comprise various high-modulus materials, such as para-aramid (e.g., KEVLAR®) or carbon. In the case of carbon, the carbon content of the tows can be about 65 to 99.9 percent, and advantageously is approximately 95 percent.

The stretch-breaking process is an important aspect of the invention. In accordance with the invention, the total draft ratio (i.e., the ratio of the surface speed of the fiber exiting the final nip rolls to the surface speed of the fiber entering the initial nip rolls) is relatively low, such as about 1.5 to 3.0, more preferably about 1.5 to 2.5, and most preferably about 2.0. It has been found that heavy carbon tows can be stretch-broken at relatively high speed (e.g., about 100 to 500 feet per minute) with relatively low waste (e.g., about 15% or less) being produced. In contrast, alternative devices that rely on mechanically cutting or breaking the filaments into staple fibers, such as the known types of "turbo" machines (as illustrated, for instance, in FIG. 2 of U.S. Pat. No. 4,698,956) or the known types of "Pacific" converters (as illustrated, for instance, in FIG. 4 of the '956 patent), would result in much higher waste, and inferior quality and uniformity of the staple yarns produced. The uniformity and relatively great length of the staple fibers produced by the process of the present invention are believed to be key factors in the retention of tensile and flexural strength properties of the spun yarn, as well as in the achievement of shear strength as good as and even better than that of continuous-filament yarn.

Following the stretch-breaking step, the staple fibers are collected in sliver cans. The next step of the process is to advance the staple fibers from the sliver cans directly to a spinning machine, where the fibers are spun into yarn. Alternatively, it is possible to advance the fibers directly from the stretch-breaking apparatus to the spinning machine, but this is not as advantageous because the stretch-breaking process is potentially substantially faster than the spinning process and it is desirable to conduct the stretch-breaking process as fast as possible to improve overall throughput. At any rate, an important aspect of the invention is that no intermediate processes are performed between the stretch-breaking and the actual spinning processes, which minimizes damage to the staple fibers.

Various types of conventional spinning equipment can be used in accordance with the invention. For example, good results have been obtained with ring-spinning equipment. However, other types of spinning machines such as air jet, friction, or vortex spinning machines are usable in the practice of the invention.

High-strength spun yarns produced in accordance with the process of the invention advantageously have a cotton count (defined as the number of 840-yard strands per pound) from about 1 to about 50. Plied yarns can also be produced by twisting together two or more strands of the yarn, preferably with a twist opposite to that of the individual strands.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

An object of this invention is to produce spun yarns from high-modulus filaments such as carbon or para-aramid filaments, having physical performance properties very near to and in some cases exceeding those of comparable filament yarns, from a heavy-denier filament tow precursor using a simple two-step, high-speed process of stretch-breaking and spinning. It has been found that using a section of a commercially-available stretch-breaking apparatus, such as a Type 870 Stretch-Break Converter manufactured by Seydel Maschinenfabrik GmbH, it is possible to produce long random length (5.0–6.0 inches) staple carbon slivers having high uniformity and which can be used directly to spin high-quality carbon yarns on yarn spinning equipment. The tensile strengths of the spun carbon yarns are typically 80–85% of comparable carbon filament yarns, while flexural strengths are typically 85–88% of comparable filament yarns. However, the shear strengths attained with the spun carbon yarns of this invention can be 26–39% greater than shear strengths attained with comparable filament carbon yarns. In addition, the quality and physical appearance of the spun carbon yarns of this invention are excellent, which is attributable to the simple fast two-step process that requires a minimum of processing and thus a minimum of fiber damage during conversion of the heavy-denier carbon tow into fine carbon spun yarns.

The reason that such excellent (and somewhat unexpected) performance properties are attained with yarns of this invention might be explained by the long random staple lengths and high uniformity of staple fibers that are attained in stretch-breaking the carbon filament tow. The stretch-breaking process of this invention uses four Godet rolls to cause the single or multiple filament tow strands to spread out in a flattened fiber array in tandem with three sets of heavy-duty high-pressure nip rolls, which stretch and break the filaments into long random lengths at very low (1.5 to 3.0, more preferably 1.5 to 2.5, most preferably about 2.0) total drafts. This is a very important aspect of the stretch-breaking process, in that the low draft ratio enables excellent control of the fiber during the stretch-breaking process. The single or multiple slivers emerging from the nip rolls are collected in sliver cans for feeding directly into the spinning frame. Resulting spun yarns may be used as singles yarns or they may be plied and cabled as needed for specific applications.

Figure 1:
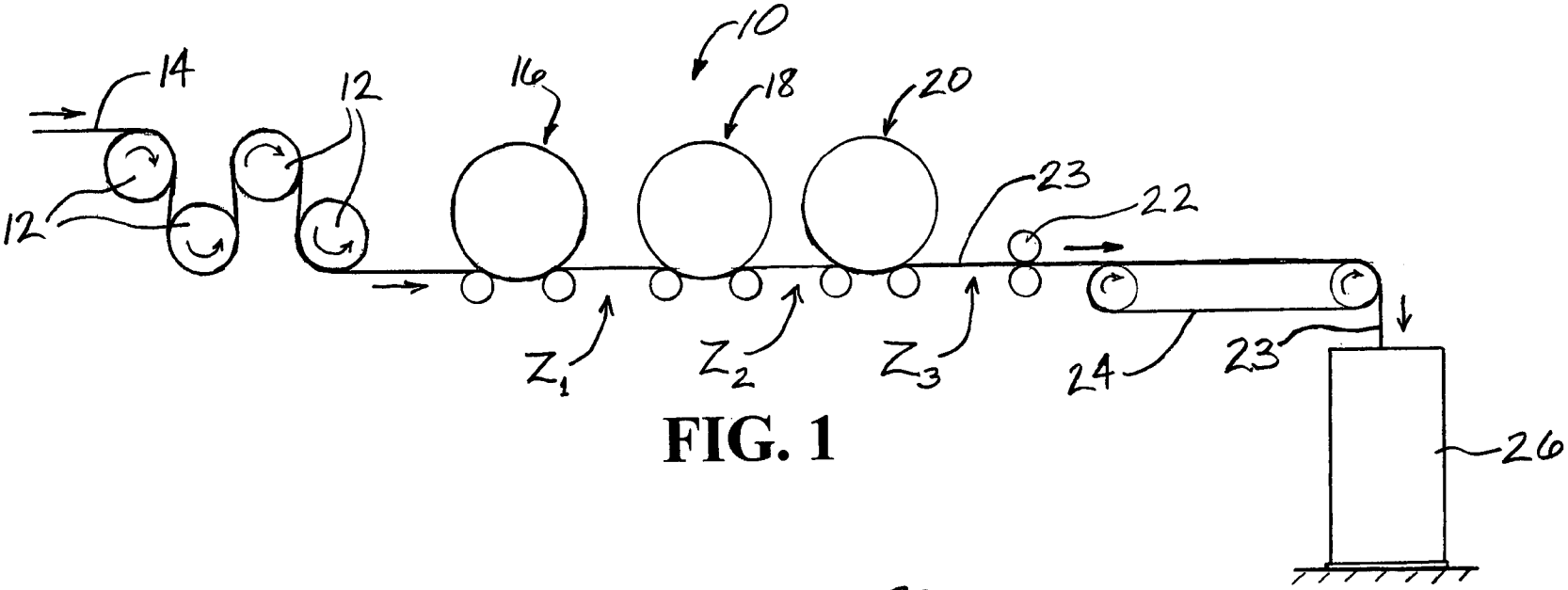
FIG. 1 is a diagrammatic depiction of the stretch-breaking portion of the process in accordance with an embodiment of the invention.
Figure 2:
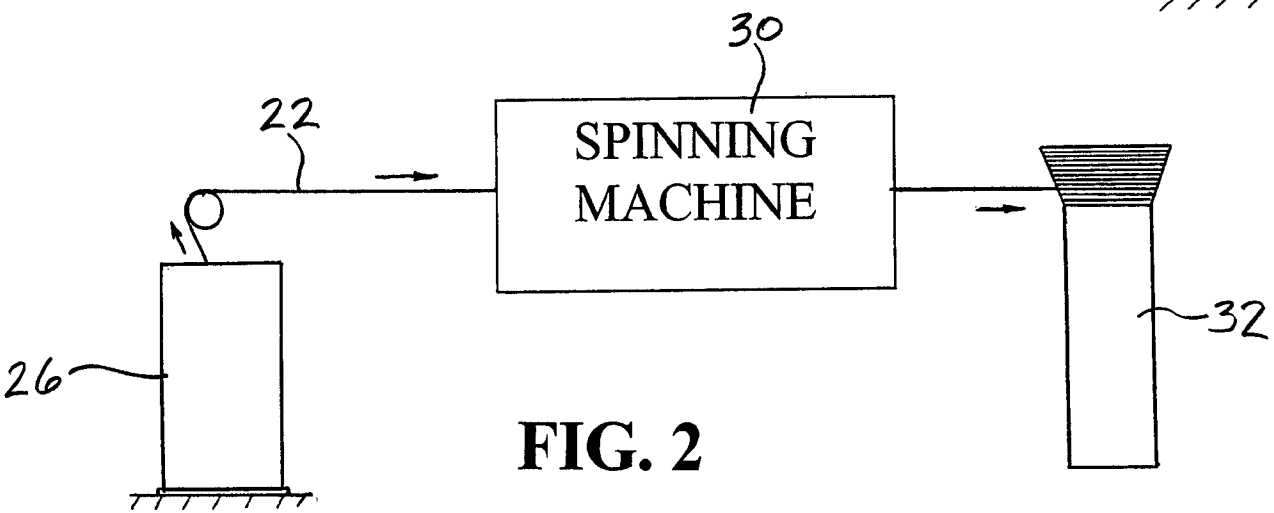
FIG. 2 is a diagrammatic depiction of the spinning portion of the process in accordance with an embodiment of the invention.

A process for making high-strength spun yarn in accordance with one embodiment of the invention is schematically illustrated in FIGS. 1 and 2. FIG. 1 depicts a first part of the process wherein one or more heavy-denier tows of substantially continuous filament, high-modulus material such as carbon or para-aramid (KEVLAR®) are converted into one or more slivers of staple fibers by a stretch-breaking process. FIG. 2 shows a second part of the process wherein the sliver of staple fibers is fed to a conventional spinning machine and spun into a yarn.

With reference to FIG. 1, the stretch-breaking apparatus 10 includes a plurality of Godet rolls 12 arranged such that one or more tows 14 of substantially continuous filament, high-modulus material pass around the Godet rolls in serpentine fashion. The Godet rolls are rotatably driven all at the same surface speed from one roll to the next such that the rolls cause the strand to spread out in a flattened fiber array prior to advancement of the tow(s) into the stretch-breaking zones of the apparatus.

The stretch-breaking apparatus 10 further includes three sets of nip rolls 16, 18, 20 forming two zones $Z_1$ and $Z_2$ in which the one or more tows 14 are tensioned and stretched in a two-stage process. The first set of nip rolls 16 are rotatably driven at a slightly faster speed than that of the Godet rolls. As an example, the draft ratio between the first set of nip rolls 16 and the last Godet roll 12 can be about 1.10 to 1.30, more preferably about 1.15 to 1.25. The first set of nip rolls thus take out slack and pre-tension the tow(s). A first stretching zone $Z_1$ is formed between the first set of nip rolls 16 and the second set of nip rolls 18. The second nip rolls 18 are driven at a slightly faster speed than the first nip rolls 16. For instance, the draft ratio between the second nip rolls 18 and the first nip rolls 16 can be about 1.15 to 1.40, more preferably about 1.20 to 1.30. In the first zone $Z_1$, the one or more tows 14 are further tensioned, but substantially no breakage of the filaments occurs in the first zone. The filaments are tensioned to a point somewhat near their ultimate tensile strength in the first zone.

The third set of nip rolls 20 are driven at a speed slightly greater than the second nip rolls 18, to further tension the filaments until they break. The draft ratio in the zone $Z_2$ between the third and second nip rolls can be about 1.15 to 1.45, more preferably about 1.25 to 1.35. The apparatus also includes a fourth set of nip rolls 22 that are driven slightly faster than the third set of nip rolls 20 to assure positive tension on the stretch-broken sliver in the zone $Z_3$ defined between the third and fourth sets of nip rolls. The draft ratio in the zone $Z_3$ can be about 1.01 to 1.10, more preferably about 1.03 to 1.08, as the objective in the zone $Z_3$ is to maintain positive tension with minimum drafting of the fibers in the stretch-broken sliver.

Advantageously, the low draft ratios employed in the stretch-breaking process enable excellent control of the filaments, a relatively uniform distribution of staple fiber lengths, and a relatively small amount of waste generated in the breaking of the filaments. The overall draft ratio between the last nip rolls 22 and the last Godet roll 12 advantageously is about 1.5 to 3.0, more preferably is about 1.5 to 2.5, and most preferably is about 2.0.

As a result of the stretch-breaking process, the one or more tows are broken into staple fibers that have an average length that preferably is in the range of about 5 to 6 inches. Control over the staple fiber lengths is effected by adjusting the spacing distance between the third nip rolls 20 and the second nip rolls 18. One or more slivers 23 of staple fibers exit from the fourth nip rolls 22 onto a delivery belt 24 running at a draft ratio, relative to the fourth nip rolls, of about 1.01 to 1.05, which is just fast enough to prevent compaction of sliver on the belt. The one or more slivers 22 are delivered into sliver cans 26. Advantageously, no processing that could lead to further distortion of the alignment of the staple fibers or damage to the staple fibers is performed on the sliver after the stretch-breaking process and up to the time that the sliver is spun into yarn. In the embodiment of FIGS. 1 and 2, therefore, the sliver is delivered directly from the stretch-breaking apparatus 10 into sliver cans 26.

As illustrated in FIG. 2, in the next step of the process, the sliver 22 is fed from the sliver cans 26 to a spinning machine 30, which spins a yarn of desired size and twist properties by suitable setup of the spinning machine in known fashion. The spun yarn is wound onto a suitable yarn carrier 32 for subsequent use. Various types of spinning machines can be used in the practice of the invention, including but not limited to ring spinning machines, air jet spinning machines, vortex spinning machines, friction spinning machines, and the like.

Figure 3:
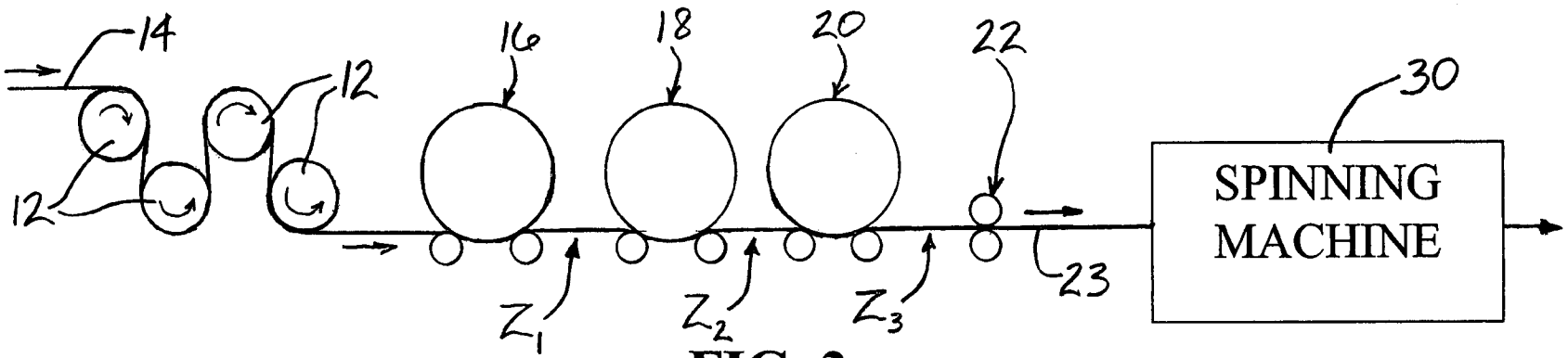
FIG. 3 is a diagrammatic illustration of a process in accordance with another embodiment of the invention, wherein staple sliver is advanced directly from the stretch-breaking process to the yarn spinning process without intermediate collection in sliver receptacles.

FIG. 3 depicts an alternative embodiment of a process in accordance with the invention. The process of FIG. 3 is substantially similar to that of FIGS. 1 and 2, except that instead of collecting the sliver 23 in sliver cans, the sliver 23 is fed directly into a yarn spinning machine 30. As in the previously described process, no intermediate processes are performed on the sliver between the stretch-breaking process and the yarn spinning process.

The processes described above can be applied to a single heavy-denier tow 14 of high-modulus material, or multiple tows can be processed simultaneously by feeding them side-by-side through the stretch-breaking apparatus 10 and keeping them separate during the process so as to produce multiple streams of sliver that can then be collected in separate sliver cans or fed directly into a spinning machine. The process of the invention is suitable for use with economical heavy-denier tow material. Each tow advantageously has a denier from about 25,000 up to about 500,000.

Singles yarns in accordance with the invention advantageously have a cotton count in the range of about 1 to about 50. Plied yarns can also be produced by twisting together two or more strands of the yarn, preferably with a twist opposite to that of the individual strands to produce a balanced-twist multi-ply yarn. For instance, the individual strands can have S-twist and the strands can be twisted together with Z-twist, or vice versa.

EXAMPLE 1

Fortafil X0219 carbon filament (80 k, 40,000 denier) tow was fed to the Godet rolls of a Seydel Stretch-Break Converter machine from a roller-type creel arrangement. The tow strand was subjected to a 1.18 draft ratio between the Godet rolls and the first pair of nip rolls, followed by drafts of 1.24 and 1.30, respectively, in the two stretch-breaking zones, exiting onto the delivery belt with a draft of 1.07. The total draft ratio thus was about 2.0. The staple fibers were delivered into sliver cans. The sliver was fed into the back roll of a ring spinning frame with draft rolls set to deliver a 7/1 cotton count spun yarn having 6.0 turns per inch of Z-twist. Subsequently, two ends of the yarn were plied together with 4.6 turns per inch of S-twist. The resulting 7/2 cotton count yarn was without torque and yielded tensile and flexural properties that were nearly equivalent to filament carbon yarn, and shear properties that were far superior to comparable filament carbon yarn, as shown in Table I:

TABLE I

| Sample | Tensile (Ksi) | Flexural (Ksi) | Shear (Ksi) |
|---|---|---|---|
| 7/2 Spun | 373 | 266 | 16.6 |
| Filament | 464 | 320 | 12.7 |

Many modifications and other embodiments of the inventions set forth herein will come to mind to one skilled in the art to which these inventions pertain having the benefit of the teachings presented in the foregoing descriptions and the associated drawings. For instance, in the illustrated embodiment, the sliver from the stretch-breaking process is collected in sliver cans prior to spinning, but alternatively it is possible to advance the sliver or a plurality of slivers directly from the stretch-breaking apparatus to the spinning machine. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A process for making a high-strength spun yarn, comprising the steps of:

feeding one or more tows of substantially uncrimped continuous filaments of high-modulus material having a tensile modulus exceeding about $20\times10^6$ psi through a high-speed stretch-breaking apparatus comprising sequentially arranged first, second, and third sets of nip rolls forming first and second stretch-breaking zones, the second set of nip rolls being driven faster than the first set of nip rolls such that the one or more tows are tensioned in the first stretch-breaking zone, the third set of nip rolls being driven faster than the second set of nip rolls such that the one or more tows are further tensioned and caused to break in the second stretch-breaking zone into high-modulus staple fibers having an average length in the range of about 5 to 6 inches; and advancing the high-modulus staple fibers from the stretch-breaking apparatus into a spinning machine without intermediate processing of the staple fibers, the spinning machine forming a high-strength spun yarn from the high-modulus staple fibers.

2. The process of claim 1, wherein the tensile modulus of the uncrimped continuous filaments is about $33\times10^6$ psi.

3. The process of claim 1, further comprising the steps of:

conveying the high-modulus staple fibers from the stretch-breaking apparatus into receptacles; and advancing the high-modulus staple fibers from the receptacles directly into the spinning machine.

4. The process of claim 1, wherein the stretch-breaking apparatus is operated at a total draft ratio of about 1.5 to 3.

5. The process of claim 1, wherein the stretch-breaking apparatus is at a total draft ratio of about 1.5 to 2.5.

6. The process of claim 1, wherein the one or more tows each have a denier of about 25,000 up to about 500,000.

7. The process of claim 1, wherein the one or more tows have a carbon content of at least about 65 percent.

8. The process of claim 1, wherein the one or more tows have a carbon content of at least about 80 percent.

9. The process of claim 1, wherein the one or more tows have a carbon content of about 95 percent.

10. The process of claim 1, wherein the tows comprise filaments of para-aramid.

11. The process of claim 1, wherein the stretch-breaking machine operates at a linear advance rate of the one or more tows of about 100 to 500 feet per minute.

12. The process of claim 1, further comprising the step of plying together two or more strands of the high-strength spun yarn to form a plied spun yarn.

13. The process of claim 12, wherein the two or more strands of the high-strength spun yarn each has a twist in one direction, and the two or more strands are plied together with a twist in the opposite direction.

14. The process of claim 1, wherein the high-strength spun yarn is formed to have a cotton count from about 1 to about 50.

15. The process of claim 1, wherein the feeding step comprises feeding a plurality of tows and keeping the tows separate during the stretch-breaking of the tows.

16. The process of claim 1, wherein the high-modulus staple fibers are advanced from the stretch-breaking apparatus directly into the spinning machine.

17. A high-strength spun yarn, consisting essentially of high-modulus staple fibers spun together into a yarn, the high-modulus staple fibers formed of a material having a tensile modulus exceeding about $20\times10^6$ psi, the high-modulus staple fibers being formed by feeding one or more tows of substantially uncrimped continuous filaments of high-modulus material having a tensile modulus exceeding about $20\times10^6$ psi through a high-speed stretch-breaking apparatus comprising sequentially arranged first, second, and third sets of nip rolls forming first and second stretch-breaking zones, the second set of nip rolls being driven faster than the first set of nip rolls such that the one or more tows are tensioned in the first stretch-breaking zone, the third set of nip rolls being driven faster than the second set of nip rolls such that the one or more tows are further tensioned and caused to break in the second stretch-breaking zone into high-modulus staple fibers that have an average length in the range of about 5 to 6 inches.

18. The high-strength spun yarn of claim 17, wherein the high-modulus staple fibers have a carbon content of at least about 65 percent.

19. The high-strength spun yarn of claim 17, wherein the high-modulus staple fibers have a carbon content of at least about 80 percent.

20. The high-strength spun yarn of claim 17, wherein the high-modulus staple fibers have a carbon content of about 95 percent.

21. The high-strength spun yarn of claim 17, wherein the yarn has a cotton count of about 1 to 30.

22. A high-strength spun, plied yarn, comprising a plurality of strands plied together with one of S-twist and Z-twist, each strand consisting essentially of high-modulus staple fibers spun together with the other of S-twist and Z-twist, the high-modulus staple fibers formed of a material having a tensile modulus exceeding about $20\times10^6$ psi, the high-modulus staple fibers being formed by passing one or more tows of substantially uncrimped continuous filaments of said material through a stretch-breaking apparatus comprising sequentially arranged first, second, and third sets of nip rolls forming first and second stretch-breaking zones, the second set of nip rolls being driven faster than the first set of nip rolls such that the one or more tows are tensioned in the first stretch-breaking zone, the third set of nip rolls being driven faster than the second set of nip rolls such that the one or more tows are further tensioned and caused to break in the second stretch-breaking zone into high-modulus staple fibers that have an average length in the range of about 5 to 6 inches.

23. The high-strength spun, plied yarn of claim 22, wherein the high-modulus staple fibers have a carbon content of at least about 65 percent.

24. The high-strength spun, plied yarn of claim 22, wherein the high-modulus staple fibers have a carbon content of at least about 80 percent.

25. The high-strength spun, plied yarn of claim 22, wherein the high-modulus staple fibers have a carbon content of about 95 percent.

26. The high-strength spun, plied yarn of claim 22, wherein the yarn has a cotton count of about 1/n to about 50/n, where "n" is the number of strands plied together.

* * * * *

UNITED STATES PATENT AND TRADEMARK OFFICE

CERTIFICATE OF CORRECTION

PATENT NO. : 7,188,462 B2
APPLICATION NO. : 10/913930
DATED : March 13, 2007
INVENTOR(S) : Hendrix et al.

It is certified that error appears in the above-identified patent and that said Letters Patent is hereby corrected as shown below:

Column 6,

Line 67, after "is" insert --operated--.

Signed and Sealed this

Fifth Day of June, 2007

JON W. DUDAS
*Director of the United States Patent and Trademark Office*